United States Patent [19]

Hernandez

[11] Patent Number: 4,640,189

[45] Date of Patent: Feb. 3, 1987

[54] ROTARY MULTICOLOR MACHINE FOR SIMULTANEOUSLY PRINTING BOTH SIDES OF A PAPER WEB OR SHEET

[75] Inventor: Manolo Hernandez, Lausanne, Switzerland

[73] Assignee: De La Rue Giori S.A., Lausanne, Switzerland

[21] Appl. No.: 818,995

[22] Filed: Jan. 13, 1986

Related U.S. Application Data

[63] Continuation of Ser. No. 620,678, Jun. 14, 1984, abandoned.

[30] Foreign Application Priority Data

Jul. 26, 1983 [CH] Switzerland ..... 4084/83

[51] Int. Cl.[4] ..... B41F 5/16; B41F 5/22

[52] U.S. Cl. ..... 101/177; 101/179; 101/182

[58] Field of Search ..... 101/177, 178, 179, 180, 101/181-185, 217, 220, 221, 222, 137, 138, 139-143, 144, 145

[56] References Cited

FOREIGN PATENT DOCUMENTS

| | | | |
|---|---|---|---|
| EP92887 | 11/1983 | European Pat. Off. | 101/177 |
| 2094715 | 9/1982 | United Kingdom | 101/177 |
| 2094717 | 9/1982 | United Kingdom | 101/177 |
| 2095622 | 10/1982 | United Kingdom | 101/177 |

*Primary Examiner*—J. Reed Fisher

*Attorney, Agent, or Firm*—Kane, Dalsimer, Kane, Sullivan and Kurucz

[57] ABSTRACT

The machine can print on both sides of the paper either an image with juxtaposed color by means of a typographic plate inked respectively by a collecting cylinder inked in turn by selective color inking cylinders of which the number corresponds to the number of colors, or an image with superposed colors and designs by means of the plate cylinders substituted for the selective color inking cylinders and provided with printing plates inking a corresponding offset cylinder and of which the number corresponds to the number of colors and designs, or an image of each above-mentioned type. For this purpose the machine comprises a first pair of blanket cylinders operating either as collecting cylinders each adapted to ink a cylinder carrying said typographic plate of which the image is transferred via an intermediate cylinder to another blanket cylinder of a second pair on the paper, or as offset cylinders contacting said other blanket cylinder, or operating one as collecting cylinder and the other as an offset cylinder. In all cases, the paper passes between the blanket cylinders of the second pair. The multicolor printing on both sides may be completed by a monochrome wet offset printing.

6 Claims, 6 Drawing Figures

ROTARY MULTICOLOR MACHINE FOR SIMULTANEOUSLY PRINTING BOTH SIDES OF A PAPER WEB OR SHEET

This is a continuation of co-pending application Ser. No. 620,678 filed on 6/14/84 now abandoned.

FIELD OF INVENTION

The invention relates to a rotary multicolor printing machine for simultaneously printing both sides of web-fed or sheet-fed paper, more particularly for printing the safety background of fiduciary papers and notably bank notes, comprising a first pair of blanket cylinders, along the periphery of each cylinder a group of several cylinders each inked by an inking unit in a different color and adapted to cooperate with the corresponding blanket cylinder for applying a multicolor image thereto, each blanket cylinder having associated therewith a plate cylinder carrying a typographic plate representing the complete design to be printed and being so arranged as to be inked by the relevant blanket cylinder, and comprising a second pair of blanket cylinders cooperating together and each associated with one of the blanket cylinders of said first pair and arranged for transferring the corresponding multicolor image to one or the other side of the paper moving between said blanket cylinders of said second pair.

PRIOR ART

In a German patent application (DE-A-31 09 964) now published there is disclosed a machine of this type which is capable of printing on both sides of the paper an image with juxtaposed colors. Each image is printed by means of a single typographic printing plate representing the complete design to be printed and mounted on one of said plate cylinders. This typographic plate is inked by a collecting cylinder consisting of one of said blanket cylinders of the first pair which is inked in turn by a plurality of selective color inking cylinders consisting of said group of cylinders and of which the number corresponds to the number of colors of an image to be printed. Each selecting cylinder comprises relief cut areas representing the portions of the image which are to be colored in a predetermined color transferred thereto by its inherent inking unit. This machine is used notably for printing the safety background of bank notes.

To achieve the simultaneous printing, the paper passes between the two blanket cylinders of the second pair which are pressed against each other and transfer the image of one or the other inked typographic plate to one or the other side of the paper.

With this method commonly referred to as the "Orlof" method (or collecting printing of the colors) a multicolor image ensuring a perfect registration between the various colors of the image design is obtained, a result that cannot be obtained with any other printing method.

Since the color selecting cylinders engage a resilient surface of the collecting cylinder, they can be made from hard material, so that very fine relief areas, consequently very fine colored areas, for example in the form of lines or points, can be cut out.

On the other hand, the indirect or offset typographic impression with superposed colors and designs is known which, likewise, is frequently used for printing safety backgrounds. According to this method, the complete design consists of partial designs of different colors carried by printing plates mounted on plate cylinders so as to permit the superposition of the designs and colors in mutual registration on a blanket cylinder against which the paper to be printed is pressed. The number of printing plates and consequently of plate cylinders corresponds to the number of different colors and designs constituting the multicolor image. There are also machines of this type for simultaneously printing both sides of the paper, wherein the paper is caused to pass between two blanket cylinders each adapted to receive a multicolor image from the corresponding plate cylinders.

In the present state of the art, machines have been developed which exploit each separately one or the other of the above-described methods.

SUMMARY OF THE INVENTION

It is the object of this invention to provide a same and single machine for simultaneously printing both sides of the paper, with the possibility of utilizing the two above-described methods referred to hereinbelow as the "Orlof" method and the offset method, and also both methods simultaneously for obtaining an Orlof printing on one side and an offset printing on the other side of the paper, while permitting the passage from one method to the other method in the simplest possible manner.

For achieving this object, the invention is characterized by a machine as disclosed in claim 1.

The advantage of this machine is not only of technical order because it permits of operating with two completely different methods, as well as the combination of both method simultaneously, but also of economical order since it enables the user to choose the method without resorting to three separate machines. The machine transformations required for switching from one method to another method are very simple.

Advantageous forms of embodiment of the invention are described in the depending claims.

The invention will now be described by way of non-limiting example through two forms of embodiment with reference to the accompanying drawings.

BRIEF DESCRIPTION OF THE DRAWINGS

The Figures differ only in relation to the arrangement of certain component elements, therefore the same elements are designated by the same reference numerals throughout the figures.

DESCRIPTION OF THE PREFERRED EMBODIMENTS

Figure 1:
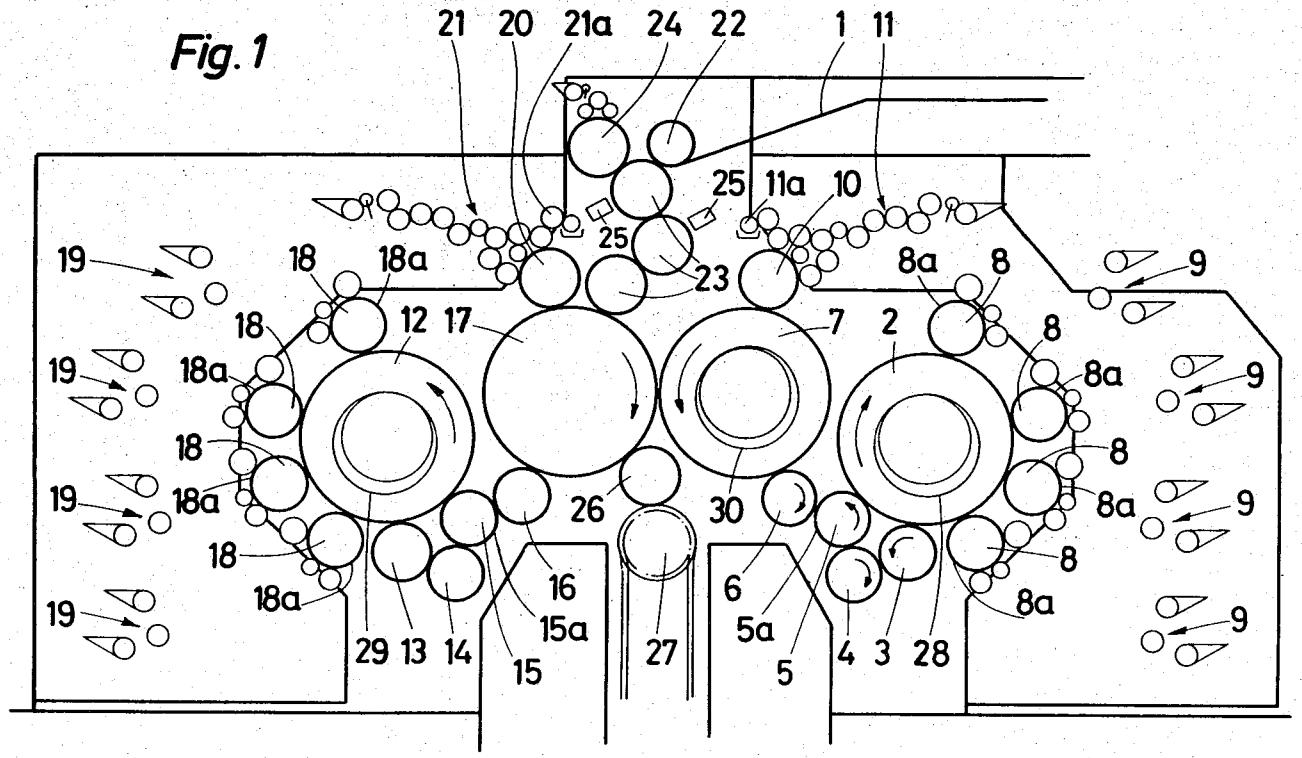
FIG. 1 illustrates diagrammatically for a sheet printing machine the position of all the component elements when it prints according to the "Orlof"-"Orlof" method.

The machine illustrated is a sheet printing machine comprising an input device for the paper 1 in sheet form which is provided with a stop drum 22, transfer drums 23 provided with grippers, and possibly a device 24 for numbering the edges of the sheets and a dedusting and static electricity eliminator device 25 installed on both sides of the paper 1. The sheets are transferred to a blanket cylinder 17 provided with grippers and constituting with another blanket cylinder 7 of same diameter a first pair of blanket cylinder which are pressed against each other and between which the sheets are printed simultaneously on both sides. The cylinders rotate in the directions shown by the arrows. After having been printed, the sheets are transported by a transfer drum 26 and a chain gripper system 27 to output piles or, as the case may arise, to a machine for completing the printing process.

Figure 2:
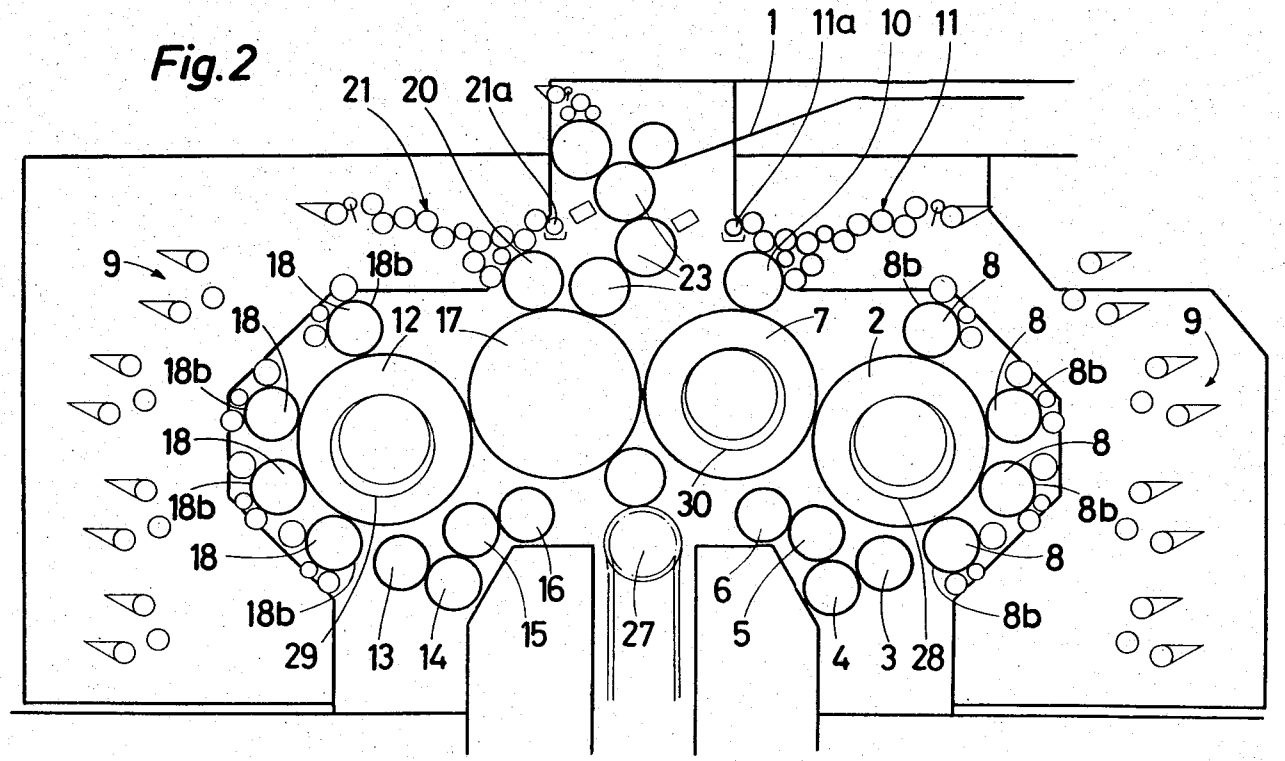
FIG. 2 illustrates diagrammatically the same machine disposed for the offset-offset printing.
Figure 3:
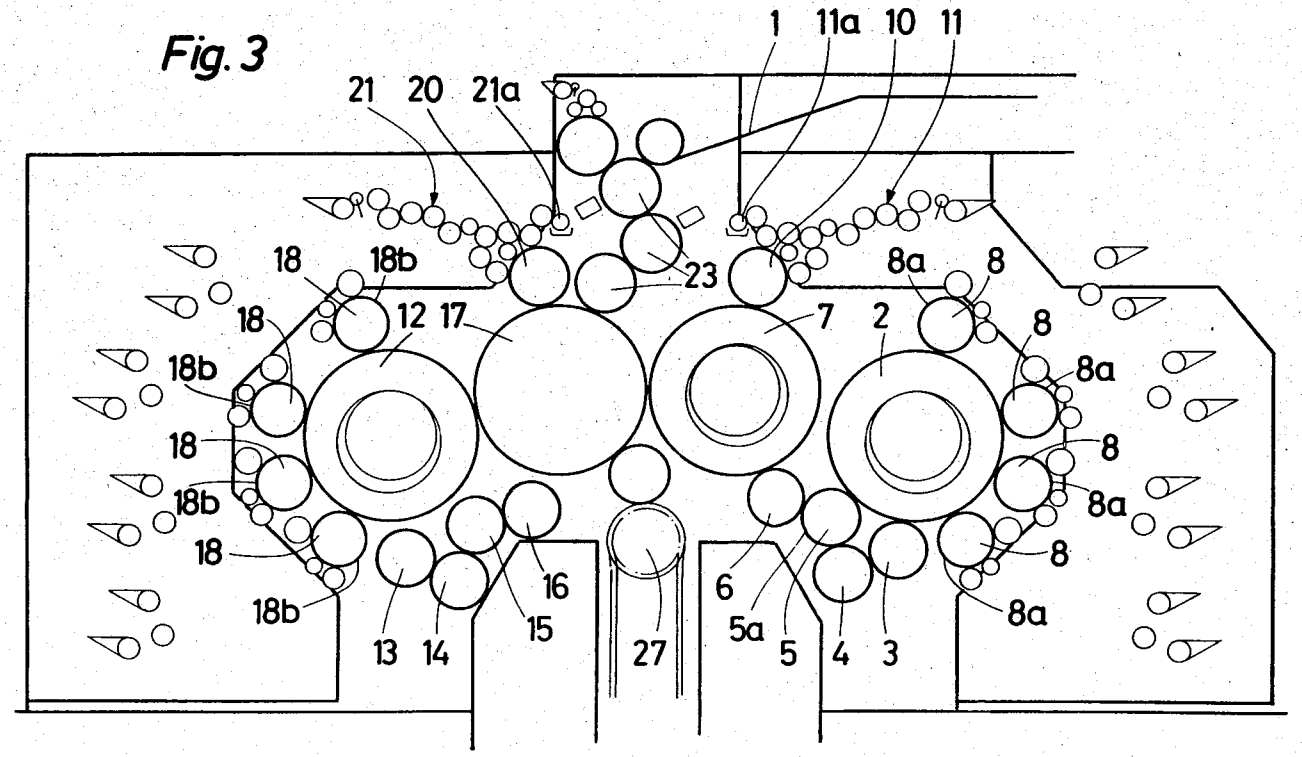
FIG. 3 illustrates diagrammatically the same machine when it prints according to the offset-"Orlof" method.
Figure 4:
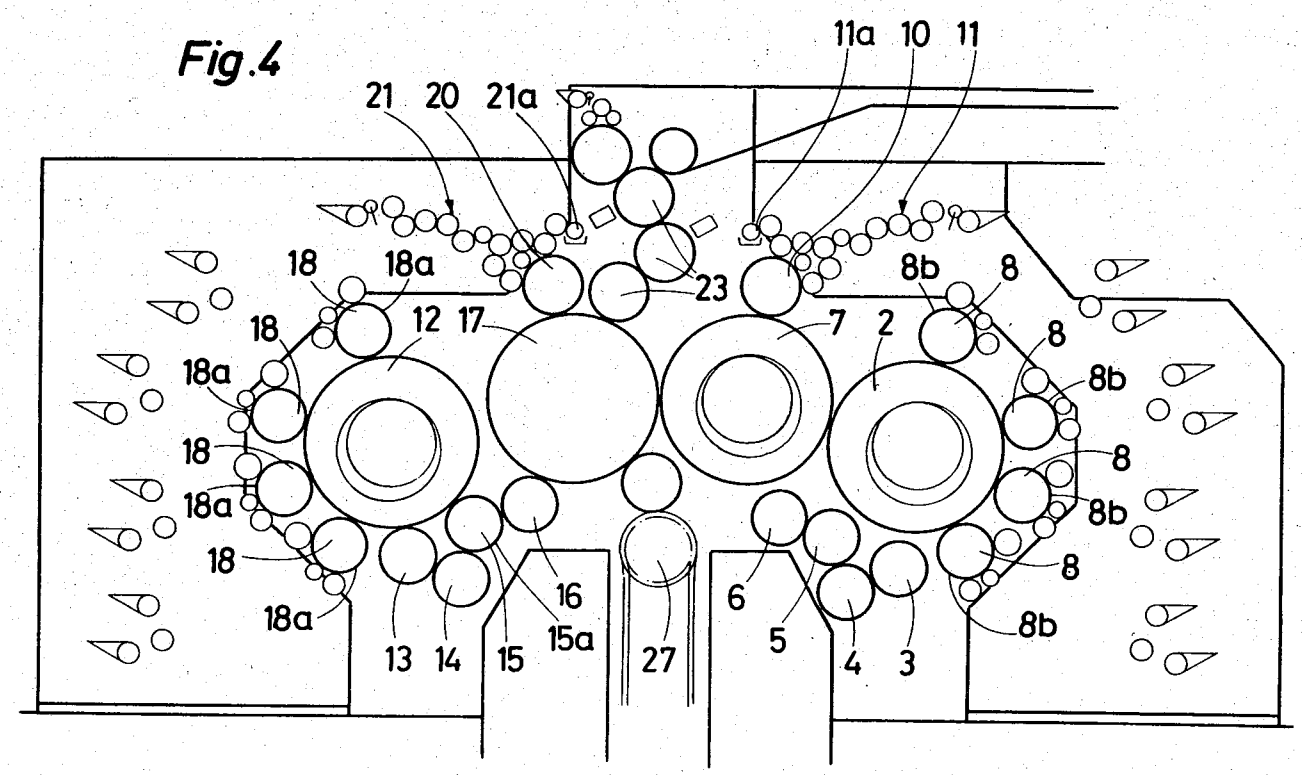
FIG. 4 illustrates diagrammatically the same machine when it prints according to the "Orlof"-offset method, the two halves of the machine being exchanged with respect to FIG. 3.

The paper 1 may be printed either according to the "Orlof"-"Orlof" method (FIG. 1), or according to the offset-offset method (FIG. 2), or according to the offset-"Orlof" method, the offset image being if desired on the first side and the "Orlof" image on the back side (FIG. 3), or vice versa (FIG. 4). In all cases, the paper 1 passes between the two blanket cylinders 7,17 pressed against each other. Each one of these blanket cylinders 7,17 is associated with a blanket cylinder 2,12 of a second pair.

Except for the sheet conveyor means, the machine consists of two symmetric halves, for this reason only one half, namely the right-hand half, will be described in detail hereinafter.

According to FIG. 1 showing the arrangement for an "Orlof"-"Orlof" printing operation, the blanket cylinder 2 is spaced from the relevant blanket cylinder 7 and cooperates in the example illustrated with four selective color inking cylinders 8 having relief areas 8*a* cut according to the contour of the areas to be printed in said color, each, by means of an inking unit 9 with double inking duct. These selective cylinders 8 with their relief portions 8*a* are made preferably from hard material not prone to undergo a distortion even if the relief is very fine, so that a safety background consisting of very fine lines can be obtained.

The four-color areas are transferred to the blanket cylinder 2 operating as a collecting cylinder on which they are combined and by which they are transferred to a plate cylinder 5 carrying a typographic printing plate 5*a* contacting said collecting cylinder. This plate 5*a* represents the complete design to be printed in four colors. The complete image inked in the different colors is transferred in turn via an intermediate rubber cylinder 6 to blanket cylinder 7 of same diameter as blanket cylinder 2, which cooperates with the blanket cylinder 17 of the other half of the machine for applying the printing of the complete image to the corresponding side of the paper. The intermediate cylinder 6 is necessary due to the direction of rotation of blanket cylinder 7.

The machine further comprises a first image-transmitting cylinder 3 and a second image transmitting cylinder 4 which transfer the same image of the colored areas of blanket cylinder 2 in perfect registration on the typographic plate cylinder 5, thus permitting of reinforcing the inking of the typographic plate 5*a* in the desired colors and consequently of better covering these areas with the desired ink. In fact, considering the direction of rotation of blanket cylinder 2, one portion of the ink is transferred via cylinders 3 and 4 to typographic plate 5*a* of plate cylinder 5 while the rest of the ink is transferred in perfect registration directly to plate cylinder 5. The arrangement of the cylinders involved for obtaining this double inking is known per se (DE-A-3109964), the second inking step being shifted by the length of the periphery of plate cylinder 5 or in the example considered herein by one-third of the periphery of blanket cylinder 2 because the latter has a diameter corresponding to three times the diameter of cylinder 5 and carries three blankets.

To meet this registration requirement, the arrangement of cylinders 2,3,4 and 5 is such that the sum of the arc lengths on the peripheries of cylinders 3,4 and 5 between the corresponding points of contact—as seen in the direction of rotation of these cylinders—must be equal to the arc length measured on the periphery of cylinder 2 between the points of contact of this cylinder with cylinders 3 and 5, plus ⅓rd of the periphery of this cylinder 2.

In the example considered herein the printing according to the "Orlof" method is completed by a wet offset impression also accomplished when the paper passes between blanket cylinders 7 and 17, which is intended more particularly for printing a main monochrome design of currency paper. The wet offset comprises an intaglio plate cylinder 10 provided with an inking device 11 and a dampening device 11*a*, known per se, this intaglio plate cylinder 10 cooperating with blanket cylinder 7 transferring the image to the paper. Therefore, in the example discussed herein, a complete printing is obtained in one and single pass, for example the four-color safety background by the "Orlof" method and the main monochrome design by a wet offset printing.

Simultaneously another image is printed on the other side of the paper by blanket cylinder 17. This other image is created in a similar manner by the corresponding members of the other half of the machine, namely by the four cylinders 18 comprising relief areas 18*a* inked by the four inking units 19, by the collecting cylinder represented by the other blanket cylinder 12, by the image transmitting cylinders 13 and 14, and by the plate cylinder 15 provided with the typographic plate 15*a* representing the complete design of said other image transferred via an intermediate rubber cylinder 16 to blanket cylinder 17. This "Orlof" printing is completed by a wet offset printing by means of an intaglio plate cylinder 20 engaging the blanket cylinder 17 and provided with an inking device 21 and a dampening device 21*a*. During the simultaneous printing the two blanket cylinders 7 and 17 act mutually as counter pressure cylinders.

In the example illustrated the ratio of the diameters of cylinders 3,13,4,14,5,15,6,16,8,18,10,20, on the one hand, to the diameters of cylinders 2,12,7,17, on the other hand, is 1:3. The periphery of cylinders 2,12,7 and 17 corresponds therefore to three paper sheets, these cylinders carry each three blankets.

When the same machine is used for printing according to the offset-offset method (FIG. 2), it is only necessary to replace the selective color inking cylinders 8,8*a* and 18,18*a* with plate cylinders 8,8*b* and 18, 18*b* equipped with printing plates 8*b* and 18*b*, to press both blanket cylinders 2,12 against blanket cylinder 7 and 17, respectively, and to separate the image transmitting cylinders 3 and 13 and the plate cylinders 5 and 15 from blanket cylinder 2 and 12 respectively, and also to separate the intermediate cylinders 6 and 16 from blanket cylinders 7 and 17, respectively. Thus, cylinders 3,4,5,6 and 13,14,15,16 are inoperative and not driven, their driving system being disconnected from the machine drive.

Printing plates 8*b* and 18*b* are offset plates, notably typographic plates of the kind used in dry offset application, and comprise partial design which, as in the preceding case, are inked by inking units 9 and 19. These partial designs in different colors are combined on blanket cylinder 2 or 12, respectively, operating in this case as an offset blanket cylinder, therefore as a collector cylinder for the partial designs constituting the multicolor image. The multicolor image on cylinder 2 or 12 is transferred via cylinder 7 or 17 to the paper. Thus, a simultaneous dry offset four-color print is obtained, which is completed by a simultaneous wet offset monochrome print by means of wet offset printing units 10,11,11*a* or 20,21,21*a* respectively, on both sides, during the passage of paper 1 between the two blanket cylinders 7,17.

The gap between the various cylinders, namely between blanket cylinders 2 and 7, between blanket cylinders 12 and 17, between cylinders 3 and 5 or 13 and 15, and blanket cylinders 2 or 12 and between cylinders 6 or 16, and blanket cylinders 7 or 17, as well as the necessary movements of the other rollers and cylinders in relation to the displaced cylinders, are obtained in a manner known per se, notably by mounting all the rollers and cylinders on eccentrics. This arrangement is illustrated diagrammatically for blanket cylinders 2 and 12, having their bodies mounted on an eccentric 28 and 29, respectively, and also for blanket cylinder 7 having its body mounted on an eccentric 30 so as to be pressed against the other blanket cylinder 17. This mounting with an eccentric is well known for regulating the pressure and separating two cylinders when the machine is inoperative, the mounting being such that when the eccentric is rotated the cylinder axis is displaced. Therefore, for this gap, the invention utilizes means already known from existing machines. When two cylinders are separated, the distance between them is very small, only one or a few millimeters, the distance illustrated in the figures being strongly exaggerated. As a rule, the inking units 9 and 19 are mounted on movable carriages.

The machine also permits an offset-"Orlof" printing, as illustrated in FIG. 3.

In the example considered herein, the right-hand side of the machine performs the "Orlof" printing, by means of selective color inking cylinders 8,8*a* and plate cylinder 5 carrying a typographic plate 5*a* inked by blanket cylinder 2 operating as a collecting cylinder inked in turn by selecting cylinders 8,8*a* and spaced from blanket cylinder 7.

The left-hand side of the machine performs the offset printing by means of plate cylinders 18 provided with offset plates 18*b* that ink the blanket cylinder 12 contacting the blanket cylinder 17. In this case cylinders 13,14,15 and 16 are inoperative and spaced from cylinders 12 and 17.

In a fourth form of embodiment according to FIG. 4, the two halves of the machine are exchanged and it is the left-hand side that prints the "Orlof" image by means of selecting cylinders 18,18*a* and plate cylinder 15, and the right-hand said that prints the offset image by means of offset plate cylinders 8,8*b*.

In the cases illustrated in FIGS. 3 and 4, each side of the paper also receives a wet offset printing from the intaglio plate cylinder 10 or 20.

The possibility of selecting the side in case of simultaneous mixed printing is essential if the paper printed in the above-described machine passes through still another printing unit so that at least one of the paper sides receives a second impression, for example an intaglio print for completing the main design or, if the wet offset printing unit 10,11,11*a* or 20,21,21*a* is not used, for creating the main design.

According to a modifed version, it is possible to exchange the positions of plate cylinder 5,15 and intermediate cylinder 6,16 in the machines according to FIGS. 1 to 4. In this case, plate cylinder 5, 15 engages the blanket cylinder 7,17 while the intermediate cylinder 6,16 contacts the blanket cylinder 2,12.

Figure 5:
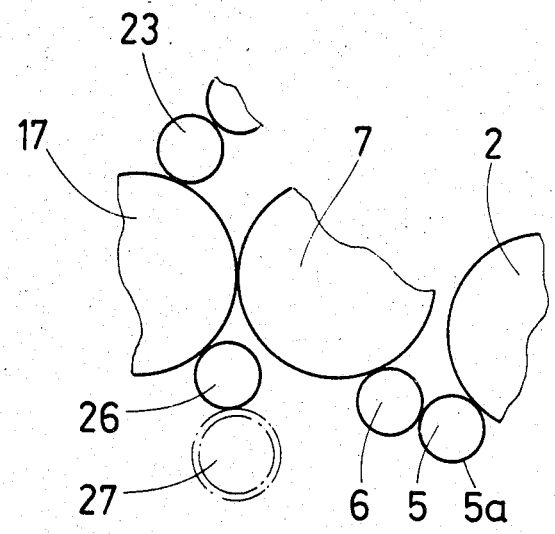
FIGS. 5 and 6 illustrate diagrammatically two modified arrangements of the means for inking the typographic plate representing the complete design.
Figure 6:
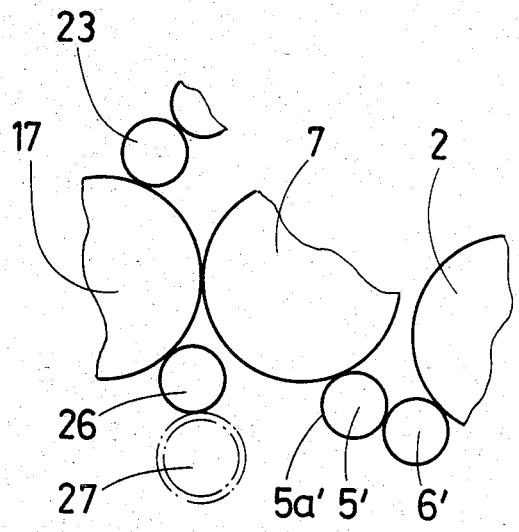

FIGS. 5 and 6 show simplified modified versions for the simple inking of typographic plate 5*a* of cylinder 5, wherein the image transmission cylinders 3 and 4 are dispensed with. According to FIG. 5, the plate cylinder 5 contacts blanket cylinder 2 and the intermediate cylinder 6 transmits the image to blanket cylinder 7, whereas, as shown in FIG. 6, it is the intermediate cylinder 6' that contacts blanket cylinder 2 and transfers the ink to the typographic plate 5'*a* of plate cylinder 5' engaging in turn blanket cylinder 7. The same mode of inking may of course be used in the other half of the machine.

This simple inking of the typographic plate 5*a* or 5'*a* for the "Orlof" printing method according to FIGS. 5 and 6 is sufficient if the design carried by this plate consists of lines.

Of course, one may dispense with the wet offset unit 10, 11,11*a* or 20,21,21*a*, mentioned within the frame of the invention, but this system, as already explained, permits of achieving a complete printing on one side of a fiduciary paper in a single pass. If sufficient space is available, one may also provide two or more wet offset printing units on at least one side.

In all the above-described examples, the selective color inking cylinders 8,8*a* and 18,18*a* intended for inking the blanket cylinder 2,12 having a collecting function may be replaced by sectioned plates operating as plates for selecting the colors applied to a cylinder. In this case, for switching from one printing method to the other it is only necessary to change the plates on cylinders 8,18 contacting the corresponding blanket cylinders, without changing the bodies of the cylinders proper.

The above-described machine may be used without any further ado as a web printing machine by simply replacing the sheet transfer means with means for conveying the web of paper passing between blanket cylinders 7,17.

In case of need at least one of the printing units comprising a plate cylinder 8 and/or 18 and an inking unit 9 and/or 19 on one and/or the other side of the machine may also consist of a wet offset unit, the corresponding plate cylinders being provided with a wet offset plate. On the other hand, as a rule the wet offset printing unit 10,11,11*a* and/or 20,21,21*a* may be replaced by a dry offset printing unit.

What is claimed is:

1. A rotary multicolor machine for simultaneously printing both sides of paper webs or sheets, more particularly for printing a safety background on fiduciary documents and notably bank notes, which comprises a first pair of blanket cylinders, each blanket cylinder having arranged along its periphery a group of several cylinders each inked by an inking unit of different ink color and each adapted to cooperate with the corresponding blanket cylinder of said first pair of blanket cylinders for applying a multicolor image thereon, each one of said blanket cylinders being associated with a typographic plate cylinder and with an associated rubber cylinder, said typographic plate cylinder being in contact with said rubber cylinder and provided with a typographic plate representing the complete design to be printed and adapted to be inked by the corresponding blanket cylinder, and a second pair of blanket cylinders cooperating together, each blanket cylinder of the second pair being associated with one of the blanket cylinders of the first pair and also with one of said typographic plate cylinders and its associated rubber cylinder, and arranged for transferring a multicolor image to one or the other side of the paper webs or sheets passing between said blanket cylinders of said second pair, and comprising means for mounting the first pair of blanket cylinders for movement away from the corresponding blanket cylinder of the second pair of blanket cylinders, means for mounting each of said typographic plate cylinders and its associated rubber cylinder for movement from a printing position to a nonprinting position and vice versa, whereby in the printing position one of said two last mentioned cylinders contacts the associated blanket cylinder of the first pair of blanket cylinders and the other of said two last mentioned cylinders contacts the associated blanket cylinder of the second pair of blanket cylinders, and in the nonprinting position each of said two last mentioned cylinders is spaced from the associated blanket cylinder of said first and said second pair of blanket cylinders, and means for converting said groups of several cylinders from selective color inking cylinders having relief areas to plate cylinders and from plate cylinders to selective color inking cylinders; and means for selectively adapting said machine to the following arrangements of adjustable or replaceable component elements:

(a) means for selectively adapting each of said groups of said several cylinders into selective color inking cylinders of which said relief areas correspond to the image portions to be colored in the various colors, and of which the number corresponds to the number of colors to be printed;

means for spacing both blanket cylinders of said first pair from said associated blanket cylinder of said second pair so as to operate as color ink collecting cylinders for inking the typographic plate of the associated typographic plate cylinder;

means for adapting each of said typographic plate cylinders and its associated rubber cylinder into their printing position so as to transfer the image from the corresponding inked typographic plate to the associated blanket cylinders of the second pair;

(b) means for selectively adapting each of said groups of said several cylinders into plate cylinders each equipped with a printing plate, the number of said printing plates for each of said groups of said several cylinders corresponding to the number of colors and designs to be printed;

means for contacting the blanket cylinders of said first pair to the associated blanket cylinder of the second pair;

wherein said typographic plate cylinders and their associated rubber cylinders have no printing function and are adapted into their nonprinting position;

(c) means for selectively adapting one of said groups of said several cylinders into selective color inking cylinders and means for selectively adapting the other of said groups of said several cylinders into plate cylinders, each provided with a printing plate;

means for spacing one of said two blanket cylinders of said first pair of blanket cylinders from said associated blanket cylinder of said second pair of blanket cylinders so as to operate as a color ink collecting cylinder for inking said associated typographic plate, said typographic plate cylinder and its associated rubber cylinder being in their printing position;

means for contacting the other of said blanket cylinders of said first pair of blanket cylinders to said associated blanket cylinder of said second pair of blanket cylinders;

wherein the typographic plate cylinder associated with said other of said blanket cylinders of said first pair of blanket cylinders, and its associated rubber cylinder, have no printing function and are adapted into their nonprinting position.

2. Machine according to claim 1, characterized by the fact that it further comprises on at least one of the sides a wet offset printing unit having a plate cylinder that contacts the corresponding blanket cylinder of the second pair.

3. Machine according to claim 1, characterized by the fact that a double inking system is provided for the typographic plate cylinder by means of two image transmitting cylinders.

4. Machine according to claim 3 further comprising a first and a second pair of image transmitting cylinders contacting and located between an associated blanket cylinder of said first pair of blanket cylinders and an associated typographic plate cylinder and means for mounting said first and second pair of image transmitting cylinders so as to move away from the respective blanket and typographic plate cylinders.

5. Machine according to claim 1 wherein said means for converting said groups of several cylinders comprises means for selectively exchanging the plates on said several cylinders from selective color inking plates to offset printing plates and vice versa.

6. Machine according to claim 1, wherein said means for converting said groups of several cylinders comprises means for selectively exchanging said selective color inking cylinders to offset printing plate cylinders and vice versa.

* * * * *